US007389870B2

(12) United States Patent
Slappay

(10) Patent No.: US 7,389,870 B2
(45) Date of Patent: Jun. 24, 2008

(54) INSTRUMENT CADDY WITH ANTI-MAGNETIC SHIELD

(75) Inventor: Robert Slappay, 238 Rockaway Tpke, Cedarhurst, NY (US) 11516

(73) Assignee: Robert Slappay, Cedarhurst, NY (US)

( * ) Notice: Subject to any disclaimer, the term of this patent is extended or adjusted under 35 U.S.C. 154(b) by 172 days.

(21) Appl. No.: 11/293,907

(22) Filed: Dec. 5, 2005

(65) Prior Publication Data

US 2007/0125931 A1 Jun. 7, 2007

(51) Int. Cl.
*B65D 85/38* (2006.01)
*H01F 7/20* (2006.01)

(52) U.S. Cl. ..... 206/305; 206/350; 206/818; 335/285

(58) Field of Classification Search ..... 206/305, 206/320, 349, 350, 523, 818; 211/DIG. 1; 248/206.5; 335/285
See application file for complete search history.

(56) References Cited

U.S. PATENT DOCUMENTS

| | | | | | |
|---|---|---|---|---|---|
| 3,251,460 | A * | 5/1966 | Edmonds | 206/523 |
| 3,286,834 | A * | 11/1966 | English, Jr. | 206/523 |
| 3,508,183 | A * | 4/1970 | Pinckard | 206/818 |
| 4,062,469 | A | 12/1977 | Rueb | |
| 4,484,682 | A * | 11/1984 | Crow | 206/818 |
| 4,912,855 | A | 4/1990 | Tatelbame | |
| 5,206,796 | A | 4/1993 | Thompson et al. | |
| 5,313,181 | A * | 5/1994 | Negus | 335/285 |
| 5,405,004 | A * | 4/1995 | Vest et al. | 206/350 |
| 5,920,188 | A | 7/1999 | Voorheis | |
| 6,237,767 | B1 * | 5/2001 | Lee | 206/818 |
| 6,571,669 | B2 * | 6/2003 | Benatz et al. | 206/350 |
| 6,742,655 | B2 * | 6/2004 | Kasakura | 206/523 |
| 6,808,067 | B2 * | 10/2004 | Benatz et al. | 206/350 |
| 7,114,618 | B2 * | 10/2006 | Arnold | 206/523 |

* cited by examiner

*Primary Examiner*—Bryon P Gehman
(74) *Attorney, Agent, or Firm*—Richard L. Strauss

(57) ABSTRACT

An instrument caddy and protection device is disclosed having a retentive pocket configured to closely adapted to, retain against displacement and protect an electronic instrument therein such as, for example, a multi-meter. The instrument caddy includes at least one magnet that enables the caddy to hold an instrument against a metallic surface during use while simultaneously protecting the instrument against breakage. Alternate embodiments of the caddy are disclosed wherein the retentive pocket is initially filled with sectioned and removable foam insert material enabling custom sizing of the retentive pocket so as to adapt to an instrument having given dimensions. In addition, preferred embodiments of the caddy provide for passageways for test cables and/or instrument straps to be attached to the instrument while it is held with the retentive pocket. Further embodiments are disclosed which include a magnetic shield incorporated within the caddy and positioned between the retentive pocket and the at least one magnet so as to protect the instrument against magnetic interference from either the caddy magnet(s) or interference originating from the surface upon which the caddy is placed.

16 Claims, 5 Drawing Sheets

INSTRUMENT CADDY WITH ANTI-MAGNETIC SHIELD

TECHNICAL FIELD

This disclosure relates to the field of electronic instrument cases and holsters. More specifically, this disclosure relates to electronic instrument holsters demonstrating the ability to position and safely hold such instrument during use.

BACKGROUND OF THE ART

Multi-meters, automotive test meters and assorted electronic specialty meters are in common use in the work place. Often these instruments are utilized in an environment posing hazzards to the instrument itself such as, for example, shock, vibration, heat and, very often, accidental dropping of the unit. These instruments may be placed in very harsh environments such as, for example, within an engine bay, or on top of a heating or air conditioning unit during use. In the past, holsters enabling service technicians to clip such devices to their belts were provided. However, such holsters did not provide a suitable and practical means of stabilizing the instrument during actual use. In addition, most of the instrument holsters of the past have been made for a specific meter or provide a relatively poor adaptation requiring removal of the instrument/meter during actual use. Once the instrument is removed from the holster for use, the meters are, of course, vulnerable to damage.

In addition to the heat and vibration relatively delicate meters are exposed to, strong magnetic fields can alter the readings of such devices. Prolonged exposure to strong magnetic fields can also damage electronic measuring tools. Many of the above described environments—in which these meters must be utilized—inherently produce strong magnetic fields. Motors within air conditioning, heating and blower units generate considerable magnetic flux. In addition, power supplies, power lines, transformers, generators and alternators can all effect delicate electronic circuitry.

What is needed is an instrument caddy which provides meter protection, close adaptation and steady positioning. It would also be highly advantageous if an instrument caddy was provided which could be adapted to closely fit electronic meters having various outside dimensions. In addition, it would be highly advantageous if a caddy could be devised which would provide protection against magnetic interference and damage to a meter protected thereby.

SUMMARY OF THE INVENTION

Now in accordance with the present invention, an instrument caddy and protection device is disclosed which provides an outer protective cover for a selected electronic instrument such as, for example, a multi-meter, current tester or other portable electronic device. The instrument caddy and protection device of the present invention is comprised of an outer housing, a retentive pocket and at least one magnet therein. The outer housing of the instrument caddy and protection device includes two side panels, two end panels, a bottom plate and a top plate. The bottom plate is especially configured and adapted to retain at least one magnet so as to enable the caddy, and an instrument retained therein, to be safely held in a given location by placing the caddy—and, more specifically, the outer surface of the bottom plate thereof—upon a surface which is attracted by the magnet.

The retentive pocket of the instrument caddy and protection device of the present invention is formed and defined by said outer housing and is especially configured and adapted to have inside dimensions which cause the retentive pocket to closely adapt to and retain a selected instrument having particular outside dimensions. Thus, the caddy is especially configured to closely hold and protect an instrument contained therein against otherwise displacing force. The at least one magnet is at least partially contained within the bottom plate and provides sufficient magnetic force to hold the instrument caddy, with an instrument therein, to a surface attracted by magnetic force such as, for example, surfaces comprised of ferrous materials.

The instrument caddy and protection device of the present invention is advantageously fabricated from a plastic material such as, for example, polyvinyl, polyether, polyester, polystyrene of polyacrylate plastics. However, certain preferred embodiments of the present invention advantageously utilize a housing fabricated from a resilient rubber compound. Such compounds display elastic properties that allow the retentive pocket to be configured so as to be slightly smaller than the instrument the caddy is designed to hold. The resilient nature of rubber compounds, such as, for example, natural, nitrile or silicon rubber compounds, enable lateral walls of the retentive pocket to stretch so as to enable initial entry of an instrument within the confines thereof. Thereafter, the resilient rubber compound enables the pocket wall to return to their initial dimensions so as to bias against and retain the instrument therewithin.

In certain alternate preferred embodiments of the present invention, the retentive properties of the retentive pocket—the tendency of the pocket to resist displacement of an instrument placed therein due, in majority, to the biasing of lateral walls of the pocket against the outer surfaces of the instrument, may be provided by configuring the housing with a retentive pocket which is custom formed. More specifically, by selective removal of foam material which is adherent to an inner surface of the bottom plate and otherwise fills the inside (area of the retentive pocket) of the caddy, a custom fit for a selected instrument to be contained therewithin may be accomplished by an end user. As discussed in more detail below, alternate embodiments of the present invention demonstrating such removable foam allows a caddy, with a given housing dimension, to be customized to contain a selected instrument by tracing the outline of the outer (lateral) walls of such instrument upon the outer surface of the foam, and thereafter removing foam, within the outline, to provide the retentive pocket. The removable foam may be selected to be, for example, a rubber, nitrile, styrene, polyvinyl or silicon foam. In addition, the foam may be pre-scored to facilitate removal thereof.

The instrument caddy and protection device of the present invention is configured, in certain preferred embodiments thereof, to contain cutouts located at one or both of the two end panels. These cutouts, as described in more detail below, enable the passage of hand straps, cable connectors and other attachments through the housing thereby enabling instruments to be fully functional while remaining within the caddy. In addition, it is preferred that at least one side panel of the housing is configured to include finger recesses therein. Such recesses increase the ease of handling and carrying the instrument caddy and protection device of the present invention while also increasing the ergonomic design thereof.

In certain preferred embodiments of the present invention, it is preferred that the bottom plate of the instrument caddy and protection device instrument caddy is configured and adapted to retain multiple magnets, such as, for example two or three magnets. In addition, the bottom plate may be formed of a plastic/magnetic particle composite wherein the bottom panel becomes the source of magnetic attractive forces for mounting the device. The magnets utilized in the present invention may be fabricated of any suitable magnetic material such as, for example, aneodymium/iron/boron, samarium cobalt, alnico, ceramic or ferrite magnets.

In alternate preferred embodiments, the bottom plate is especially configured to include—and does, in fact include—a magnetic shield therewithin fabricated from an anti-magnetic material comprised of, for example, nickel/iron alloy, commercial iron, stainless steel, nickel/iron/copper/chromium alloy, and ultra low carbon steel anti-magnetic materials.

DETAILED DESCRIPTION

Figure 1:
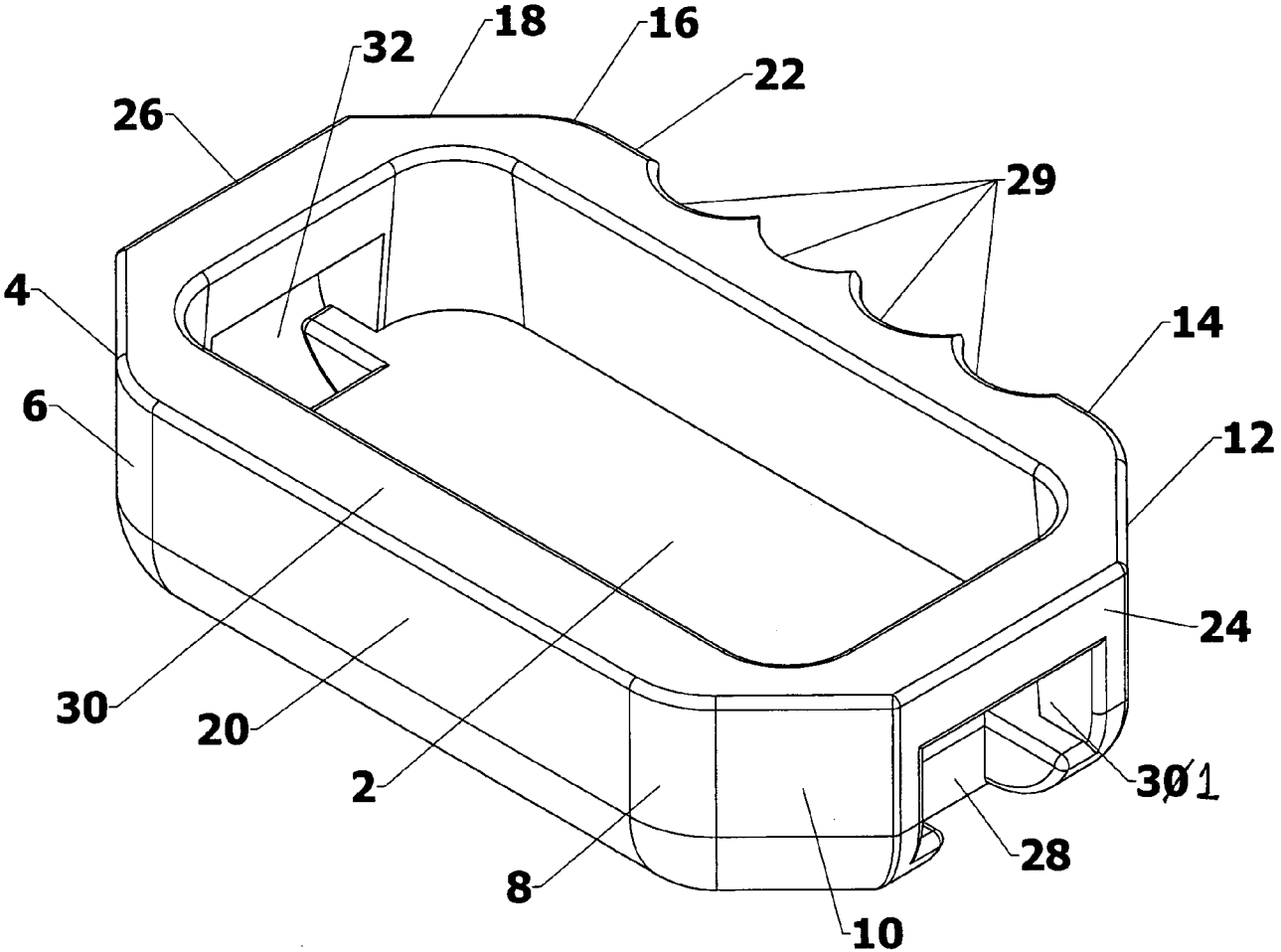
FIG. 1. is a top isometric view of a preferred embodiment of the present invention.
Figure 2:
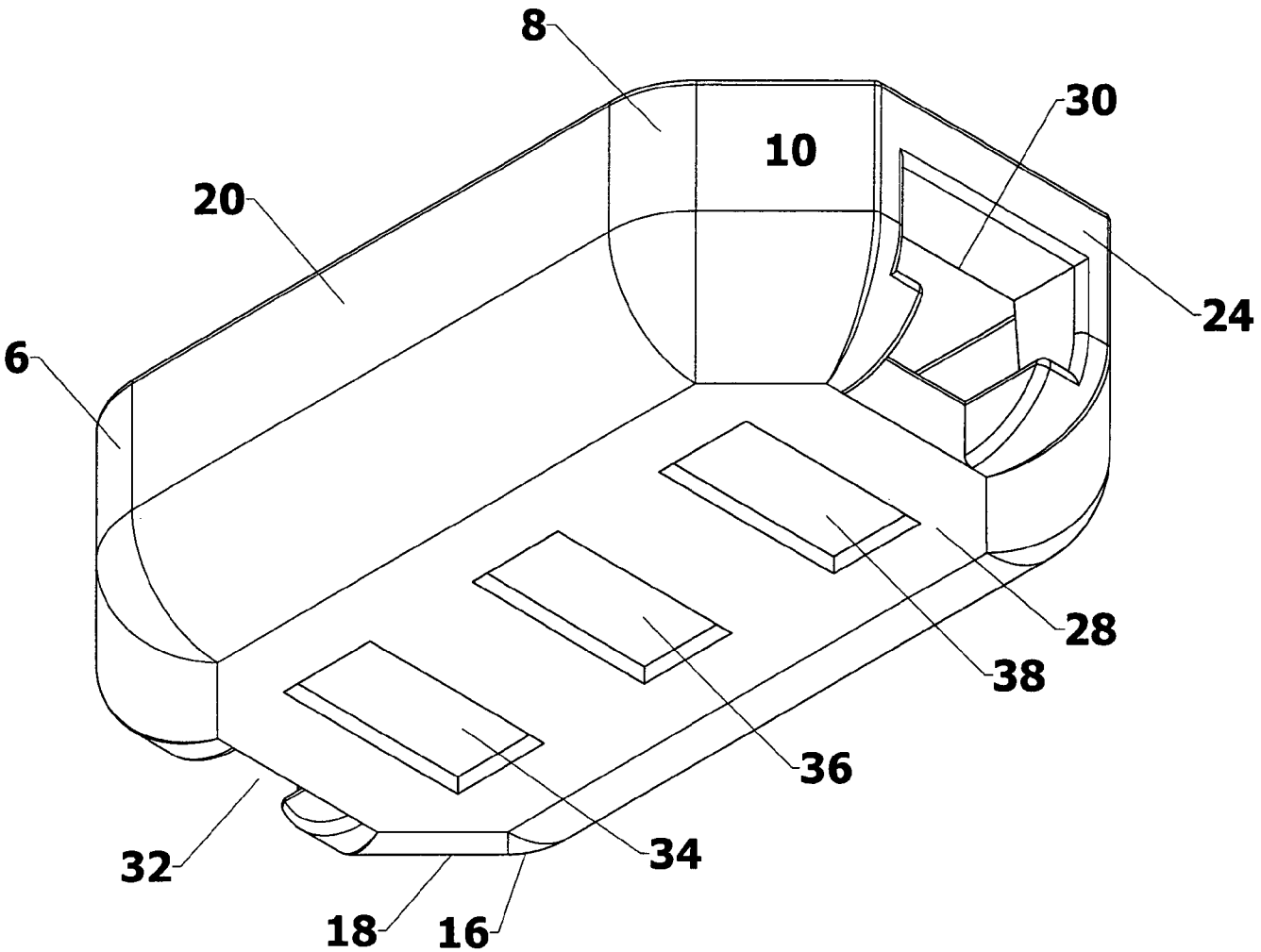
FIG. 2 is a bottom isometric view of the embodiment shown in FIG. 1.
Figure 3:
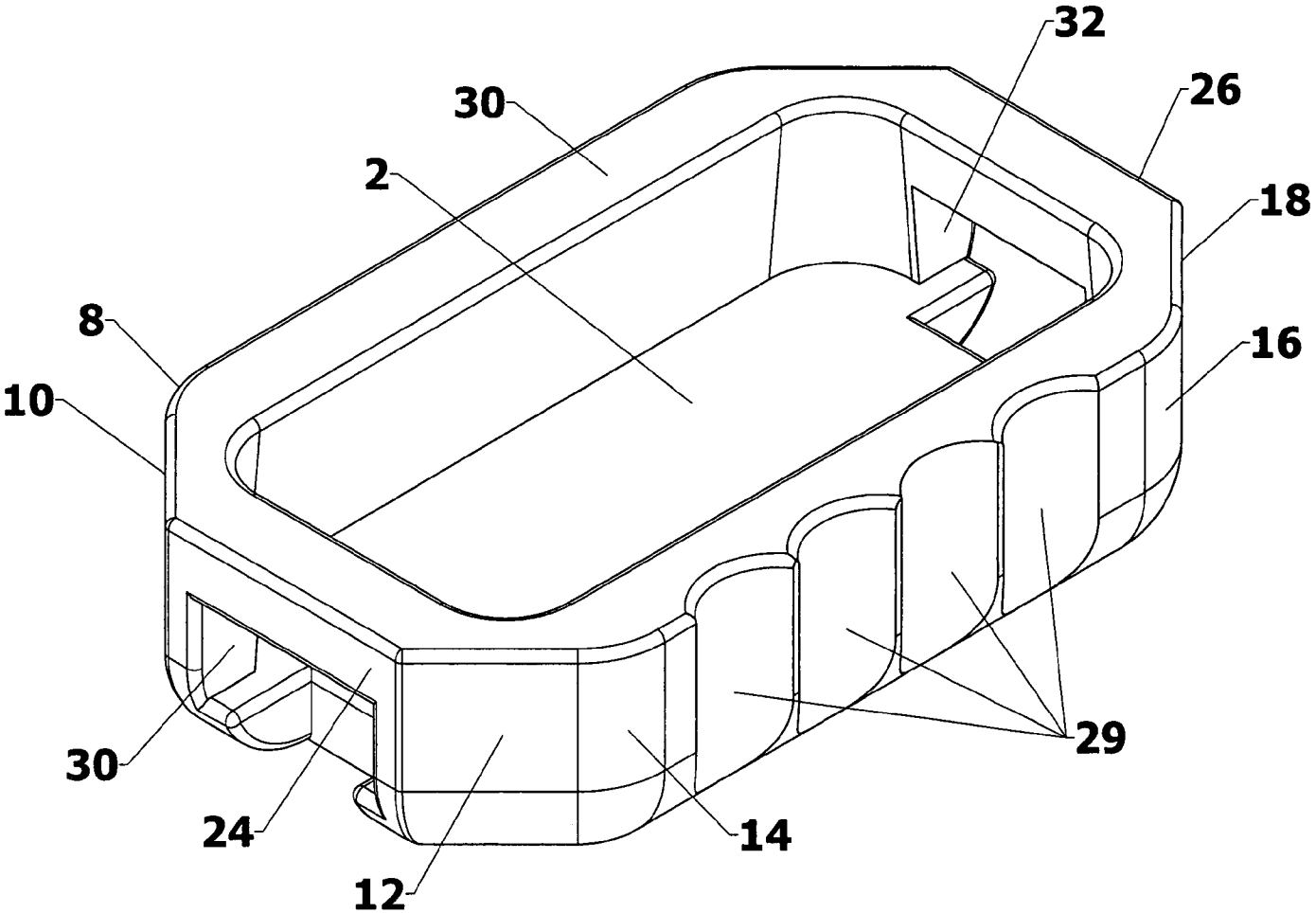
FIG. 3 is a top isometric view of the embodiment shown in FIGS. 1 and 2.
Figure 4:
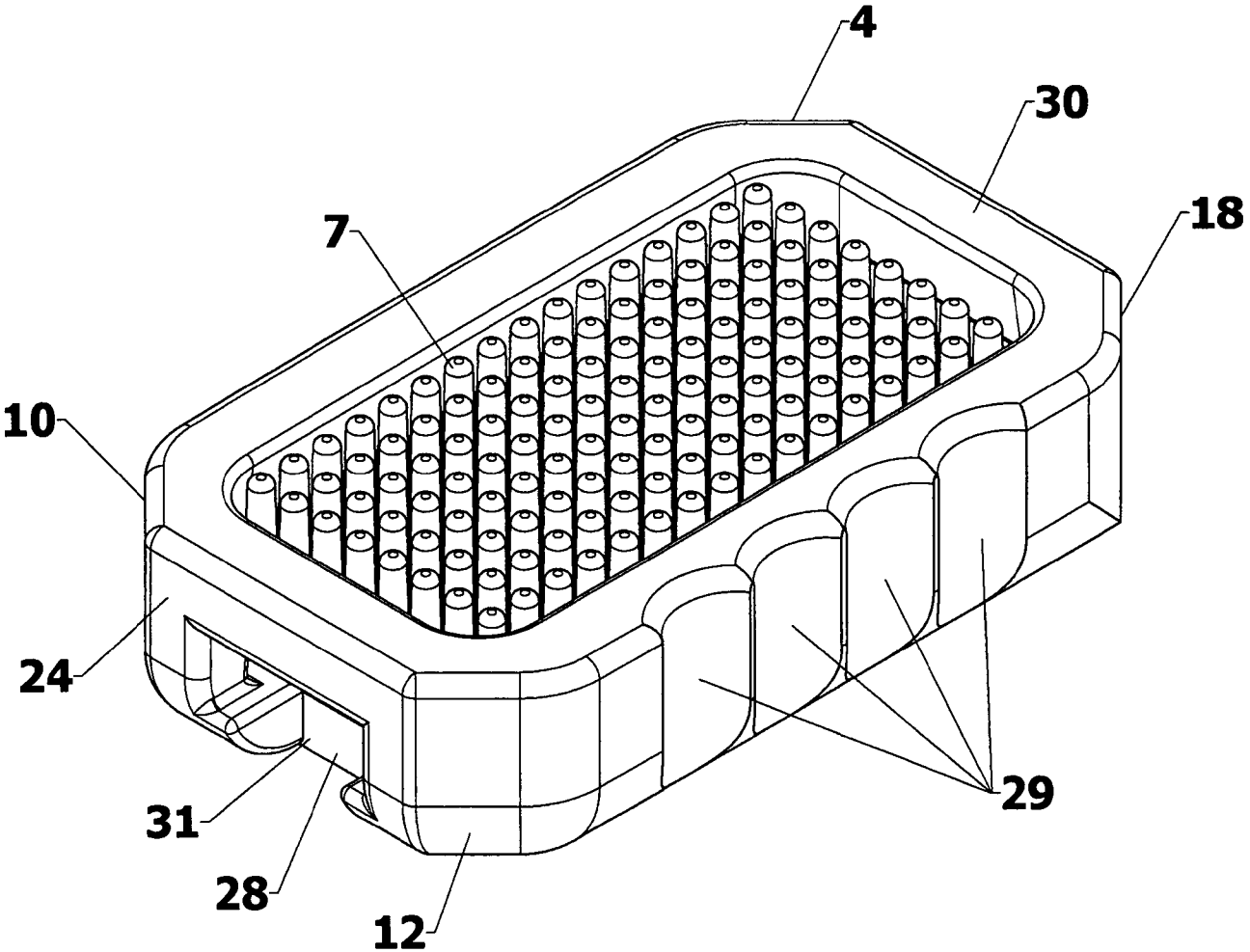
FIG. 4 is a top isometric view of an alternate preferred embodiment of the present invention.
Figure 5:
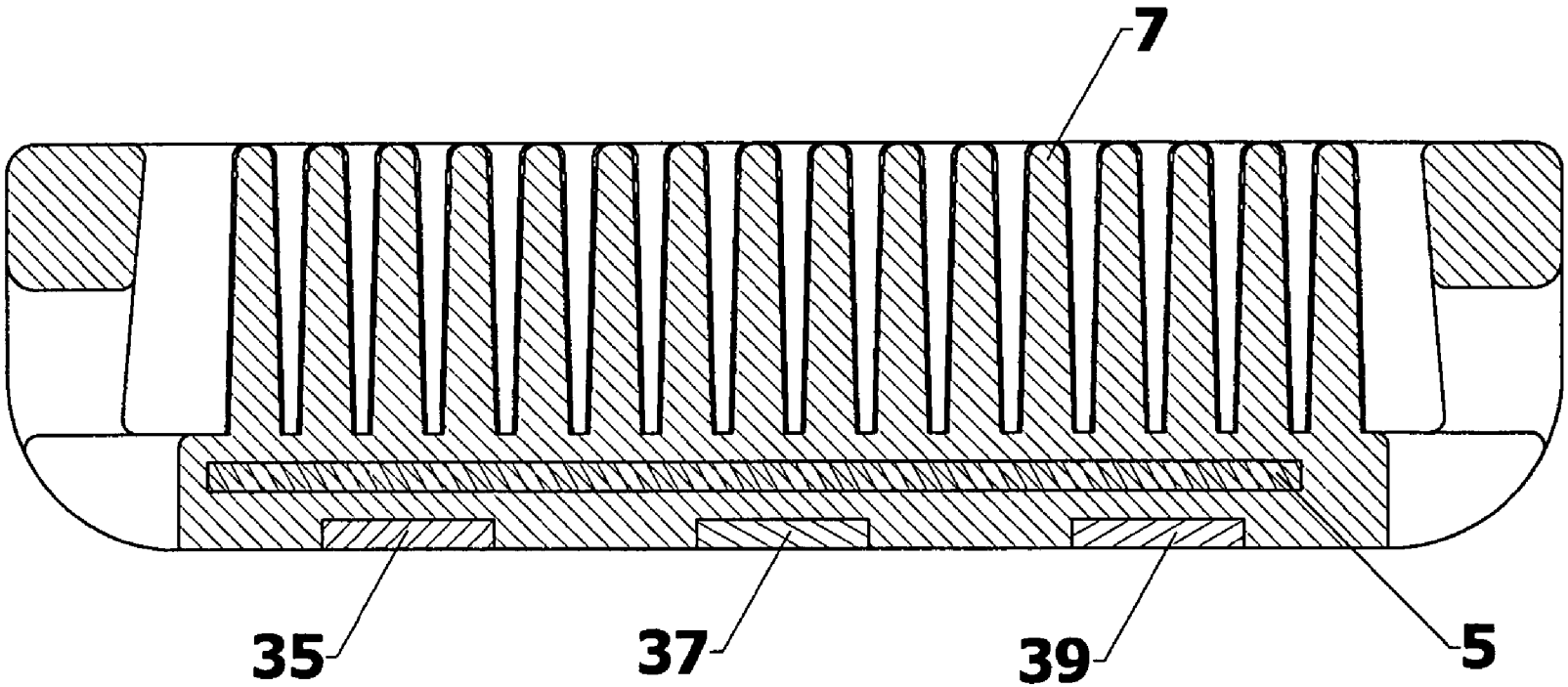
FIG. 5 is a side view of the alternate preferred embodiment of the present invention illustrated in FIG. 4.

FIGS. 1-3 illustrate a first preferred embodiment of the instrument protection and caddy device of the present invention. The device is comprised of an outer housing at least one magnet and a recessed retentive pocket. In the first preferred embodiment illustrated in the figures, the outer housing includes, surrounds and defines a recessed instrument receiver pocket. The retentive pocket (or as it may be equally referred to as "instrument receiver pocket") is especially configured so as to provide for a retentive fit of an instrument for which it is intended to be used. What is meant by the term retentive fit, is that close adaptation between the inside dimensions of the receiver pocket and outside dimensions of the instrument to be placed therein so that when the pocket faces downward (in the direction of the floor and in line with gravitational forces that might otherwise displace the instrument from the caddy) the instrument remains within the caddy.

In the embodiment of the present invention illustrated in the figures, the receiver pocket 2 is bordered and defined by the caddy housing which, in turn, and in regard to the first preferred embodiment, is comprised of corner panels 4, 6, 8, 10, 12, 14, 16, 18 side panels 20 and 22, end panels 24 & 26, bottom panel 28 and top plate 30. However, use and incorporation of corner panels is optional and not required for practicing the present invention in that two side panels, two end panels, a bottom plate and top plate are sufficient to define the required receiver pocket. Each of the aforementioned side panels illustrated in the figures is curved so as to make this particular embodiment ergonomically efficient and conformable to a user's hand grip. However, such curvature is not essential and required for all embodiments of the present invention.

At least one of side panels 20 and 22 includes finger recesses 29 in order to further enhance grip, control and handling of the device. End panels 24 and 26 include cable cutouts 31 and 32 in order to allow and facilitate the entry of lead, cable and carry strap handles into the caddy for connection with the instrument housed therewithin. The outer housing is advantageously fabricated of plastic material such as, for example, a polyether, polyester, polyvinyl, polystyrene of polyacrylate plastic. However, it is preferred that the housing be comprised of a resilient pliable materia such as, for example a natural, nitrile or silicon based rubber materials. Such rubber materials exhibit excellent moldability while also providing increased shock resistance to instruments housed within the caddy. In addition, and as discussed above, such materials demonstrate sufficient elastic memory and elasticity so as to allow expansion of the retentive pocket for receipt of an electronic instrument, followed by contraction to hold and retain the retained meter.

Bottom plate 28 includes at least one, and preferably three magnet recesses 34, 36 and 38 for the fixation of magnets 35, 37 and 39. The magnets are advantageously affixed within the magnet recesses via any suitable cement such as, for example, an epoxy or silicone based cement. In addition, the magnets may be, for example, bonded into the recesses by means of a bonding material such as, for example, an acrylic or cyanoacrylate cement. The magnets, as discussed above, serve to enable the caddy, and the instrument retained therewithin, to be conveniently affixed to any metallic surface displaying suitable magnetic attraction. Any standard magnet permanent magnet may be utilized in practicing the present invention. Neodymium/iron/boron (NdFeB or NIB), samarium cobalt (SmCo), alnico, ceramic and ferrite magnets are all suitable for use with the present invention. However it is preferred to utilize alnico magnets due to their relatively greater residual magnetic flux and, more importantly, their resistance to loss of magnetic strength when exposed to high heat (as may occur when the caddy is placed on heating/cooling equipment, engines and other heat producing surfaces. It is also contemplated that the caddy may incorporate a magnetic filing/plastic material as the bottom plate wherein the bottom plate—itself—would act as the required magnet.

In an alternate preferred embodiment of the present invention, the recessed portion 2 of the caddy is initially filled with a foam insert material 7 fabricated of any suitable foam such as, for example, a rubber, nitrile, styrene (Styrofoam), polyvinyl or silicon foam. Although closed cell type foams can be utilized, their relative rigidity may increase the difficulty in obtaining the below described "custom fit" of an instrument within the retentive pocket. Conversely, open sell foams may be more "forgiving" in conforming to a instrument, but may likewise provide less holding power. Either type of foam may be utilized. However, greater care need be exercised when utilizing closed cell foam in order to obtain a proper and retentive custom fit. The foam may be adhered to an inner aspect of the bottom plate 28 by means of any suitable adhesive compatiblizer such as, for example, a silicon, vinyl or styrene based adhesive agent. It is advantageous to utilize a pre-scored, ("tear-away) foam comprised of many pre-cut sections. The precut foam enables, in one embodiment of the present invention, the retentive pocket to be easily customized so as to line and define a recess closely configured for an electronic instrument having a specific outline shape and dimensions. More specifically, the second preferred embodiment of the present invention discloses an instrument caddy wherein sections of either solid or precut foam, within the recessed portion defined by the housing, may be removed after drawing an outline of the instrument directly upon the foam. In actual practice, the instrument to be housed within the caddy is first laid down upon the surface of the foam inserts and centered. Thereafter, any suitable marker pen is utilized to draw an outline of the instrument on the foam surface. The instrument is then removed from the surface of the foam. Thereafter, pre-cut inserts, located within the outline are removed from the caddy. The instrument may then be inserted into a custom recess that now accurately holds the device. As mentioned above, closed cell foam embodiments require more precision in foam removal and shaping since this material is less resilient and will not ordinarily expand to fill gaps between the instrument and foam outline caused by overzealous removal of foam.

In a further and alternate preferred embodiment of the present invention, the bottom plate includes an anti-magnetic shield 5 embedded therewithin. As discussed above, it is contemplated that the instrument caddy of the present invention be utilized to protect and conveniently position instruments such as, for example, electronic multi-meters, automotive diagnostic instruments and other sensitive equipment. Such devices may be susceptible to interference caused by magnetic force generated by the magnets utilized with the caddy and, in addition, magnetic forces emanating from the objects, structures and/or devices upon which the caddy might be positioned. By incorporating an antimagnetic shield within the bottom panel of the caddy, such forces, otherwise able to interfere with device function, are effectively controlled.

The anti-magnetic shield embedded within the bottom plate may be fabricated of lead, aluminum or any other suitable anti-magnetic material. Selection of a particular thickness of the shield, required for adequate anti-magnetic protection, is well known to the art and is not discussed herein. However, nickel/iron alloy, commercial iron, stainless steel, nickel/iron/copper/chromium alloy, and ultra low carbon steel are all suitable anti-magnetic materials that can be formed into sheets suitable for embedding within the bottom plate and/or integrated within a composite material utilized for forming the bottom plate. Bonded ferrite powder is extremely suitable for forming the bottom plate in such embodiments. Such powders may be selected to be, for example: These powders have excellent compatibility with a wide range of binders and plasticizers so as to enable production of a magnetic bottom plate formed via extrusion or calendering.

The anti-magnetic material provides an instrument contained within the caddy and protective device of the present invention to resist the effects of magnetic interference commonly produced by surfaces upon which such instruments are commonly placed. In addition, the magnetic shield provides a barrier between instruments held within the caddy and the magnet(s) utilized to hold the caddy to a surface for convenient use and positioning.

In certain situations, a suitable surface which would otherwise provide magnetic attraction in combination with the magnets or magnetic particles within the bottom plate of the caddy may not be available in a work area. For this reason, certain alternate preferred embodiments of the present invention include a simple extendable stand which allows the device to be positioned on a surface without use of magnetic force. In addition, other embodiments of the present invention include a simple hanger such as, for example, a hook loop so as to enable the caddy to be suspended from a fixation point at a work site. It is also contemplated that certain alternate preferred embodiments of the present invention will include a hanger and an extendable stand to provide greater flexibility in utilizing the caddy and protective device of the present invention.

The terms and expressions which have been employed in the foregoing specification are used therein as terms of description and not limitation, and there is no intention, in the use of such terms and expressions, of excluding equivalents of the features shown and described or portions thereof, it being recognized that the scope of the invention is defined and limited only by the following claims

I claim:

1. An electronic instrument caddy and protection device comprised of an outer housing, a retentive pocket and at least one magnet wherein:

the outer housing includes two side panels, two end panels, a bottom plate and a top plate and wherein said bottom plate is especially configured and adapted to retain said at least one magnet and wherein said bottom plate includes a magnetic shield therewithin fabricated from an anti-magnetic material;

said retentive pocket is formed and defined by said outer housing and is especially configured and adapted to have inside dimensions which cause said pocket to closely adapt to and retain a selected electronic instrument therewithin which said device is intended to hold and protect against damage and displacing force; and wherein said at least one magnet has and provides sufficient magnetic force to hold the device, with an instrument therein, to a surface attracted by a magnetic field generated by said at least one magnet and wherein said magnetic shield provides protection for an electronic instrument retained within said retentive pocket of the device from interference caused by magnetic force generated by said at least one magnet.

2. The instrument caddy and protection device of claim 1 wherein the housing is fabricated from a plastic material.

3. The instrument caddy and protection device of claim 2 wherein said plastic material is selected from the group consisting of a polyvinyl, polyether, polyester, polystyrene and polyacrylate plastic.

4. The instrument caddy and protection device of claim 1 wherein the housing is fabricated from a resilient rubber compound.

5. The instrument caddy and protection device of claim 4 wherein the rubber compound is selected from the group consisting of natural rubber, nitrile and silicon rubber compounds.

6. The instrument caddy and protection device of claim 1 wherein at least one of the two end panels includes cable cutouts therein.

7. The instrument caddy and protection device of claim 1 wherein at least one side panel is configured to include finger recesses therein.

8. The instrument caddy and protection device of claim 1 wherein said bottom plate is configured and adapted to retain three magnets.

9. The instrument caddy and protection device of claim 1 wherein said anti-magnetic material is selected from the group consisting of a nickel/iron alloy, commercial iron, stainless steel, a nickel/iron/copper/chromium alloy, and ultra low carbon steel anti-magnetic materials.

10. The instrument caddy and protection device of claim 1 wherein the at least one magnet is selected from the group consisting of a aneodymium/iron/boron, samarium cobalt, alnico, ceramic and ferrite magnets.

11. The instrument caddy and protection device of claim 1 wherein the bottom plate is formed of a plastic and magnetic particle composite.

12. The instrument caddy and protection device of claim 11 wherein the plastic and metal particle composite includes magnetic particles selected from the group consisting of $BaFe_{12}O_{19}$ and $SrFe_{12}O_{19}$ magnetic particles.

13. The instrument caddy and protection device of claim 1 wherein the retentive pocket is filled with foam material especially configured and adapted so as to enable selective removal of said foam material.

14. The instrument caddy and protection device of claim 13 wherein the foam material is selected from the group consisting of rubber, nitrile, styrene, polyvinyl and silicon foam.

15. The instrument caddy and protection device of claim 13 wherein the foam material is pre-scored so as to facilitate selective removal of sections thereof.

16. The instrument caddy and protection device of claim 1 wherein said magnetic shield also provides protection for an electronic instrument retained within said retentive pocket of the device from magnetic forces emanating from at least one of objects, structures and other devices upon which the device is positioned.

* * * * *